US006591769B1

(12) United States Patent
Heidtmann et al.

(10) Patent No.: US 6,591,769 B1
(45) Date of Patent: Jul. 15, 2003

(54) DEVICE FOR ADJUSTING THE CHECKING UNIT OF A PRESSER FOOT USED IN A SEWING AND/OR EMBROIDERY MACHINE

(75) Inventors: Thomas Heidtmann, Willich (DE); Bernd Kirch, Krefeld (DE)

(73) Assignee: ZSK Stickmaschinen GmbH (DE)

( * ) Notice: Subject to any disclaimer, the term of this patent is extended or adjusted under 35 U.S.C. 154(b) by 0 days.

(21) Appl. No.: 10/031,246

(22) PCT Filed: Feb. 17, 2000

(86) PCT No.: PCT/EP00/01280

§ 371 (c)(1),
(2), (4) Date: Oct. 19, 2001

(87) PCT Pub. No.: WO00/63480

PCT Pub. Date: Oct. 26, 2000

(30) Foreign Application Priority Data

Apr. 21, 1999 (DE) ..... 199 18 169

(51) Int. Cl.[7] ..... D05B 29/02
(52) U.S. Cl. ..... 112/237

(58) Field of Search ..... 112/235, 236, 112/237, 238, 220, 284

(56) References Cited

U.S. PATENT DOCUMENTS 4,508,043 A * 4/1985 Vollmar ..... 112/235
5,042,406 A * 8/1991 Jimenez et al. ..... 112/237
5,590,614 A * 1/1997 Murata et al. ..... 112/237

* cited by examiner

*Primary Examiner*—Ismael Izaguirre
(74) *Attorney, Agent, or Firm*—Factor & Partners

(57) ABSTRACT

The invention relates to a device for adjusting a checking unit of a presser foot, used in a sewing or embroidery machine. A needle bar moves the presser foot towards a needle plate, using a spring which is connected in series. The checking unit intercepts the presser foot using a checking element of the unit, before contact is made with the work piece to be sewn and controls the movement of the presser foot until the latter touches the work piece. The checking element and the needle bar are both operated by a common drive and the bedding position of the checking element can be modified in relation to the needle plate.

17 Claims, 6 Drawing Sheets

Fig. 1

DEVICE FOR ADJUSTING THE CHECKING UNIT OF A PRESSER FOOT USED IN A SEWING AND/OR EMBROIDERY MACHINE

BACKGROUND OF THE INVENTION

1. Field of the Invention

The invention concerns a device for adjusting the checking unit of a presser foot of a sewing and/or embroidery machine.

2. Background Art

Throughout the following specification and claims, the terms "checking" and "check" and "catching" and "catch" may be used interchangeably.

An embroidery machine of this type with a checking unit for a presser foot is known from DE 3117140. The checking unit disclosed in DE 3117140 achieves a situation in which the presser foot no longer strikes the workpiece to be machined and therefore the needle plate with the full force derived from the needle bar drive and transferred via the spring inserted in between, but is checked shortly before contact, a large part of the force residing in the movement of the presser foot being absorbed before the presser foot is released to perform the remaining movement with a certain time delay. The checking unit achieves a significant attenuation of the noise and protects the workpiece and/or the embroidery from damage caused by long term stress from the presser foot. The checking unit consists substantially of a control cam, which activates an angled lever, the one arm of which checks the presser foot, accelerated by a spring in the direction of the workpiece, via a checking component and releases the said foot with a time delay so that the presser foot is braked when it strikes the workpiece.

SUMMARY OF THE INVENTION

It is disadvantageous in the case of the checking unit known from DE 3117140 that, resulting from the rigid structure, the movement path of the presser foot is identical for different thicknesses of workpiece so that in the presence of relatively large workpiece thicknesses, the presser foot strikes the surface of the workpiece with too much force so that the advantages of the checking unit are reduced.

A device is described in DE 19628524, with which the presser foot is moved into a safe position after the sewing process. No adjustment to material thicknesses is provided.

A very time-consuming and expensive way is described in DE 4302094 in which the presser foot is moved via a separate drive motor thus permitting any desired movement paths and therefore adjustment to different thicknesses of material to be implemented. However, the additional drive requires a time-consuming synchronisation of the two drives for the needle bar and the presser foot.

DE 4324741 and DE 2938894 show checking units for presser foot attachments in which the movement path of the presser foot can be adjusted to the thickness of the material. It is disadvantageous in these units that they utilise complicated lever systems which have an expensive structure and are prone to breakdowns. Increased demands are imposed on the tolerances to be met because of the large number of moving parts and a relatively large amount of noise is created.

The object of the present invention is therefore to provide a checking unit for a presser foot of a sewing machine which is of a simple structure and permits an adjustment to a very wide range of workpiece thicknesses.

This object is achieved according to the invention by a device with the characteristics of claim 1.

It is advantageous in the device according to the invention that the position of the bearing of the checking element, which works in direct combination with the presser foot, is changed manually or automatically and held and/or locked in a specific position. As a result, no additional elements are necessary which have to be arranged in the force transmission region between the checking element and the drive for the checking element. The adjustment of the position of the bearing of the checking element, which is preferably an angled lever, should be able to be moved to at least two positions or any desired location between two positions and/or should be able to be locked.

In a particular embodiment of the device, the bearing and/or the swivelling axle of the checking element can be swivelled around an axis, so that the position of the checking element alters relative to the needle plate depending on the angle set. To do this, the bearing of the checking element itself is mounted in a cylinder coaxial to the latter's axis, whereby the cylinder is mounted so that it can rotate around its axis on the sewing or embroidery machine.

If the cylinder is turned, the bearing which, for example may be a bolt, which is mounted so that it rotates in the cylinder coaxial to its axis, is moved around the axis, whereby the position of the bearing and/or the bearing bolt changes in respect of the needle plate. This permits an advantageous thickness adjustment of the presser foot to the workpiece or embroidery by simple means. The cylinder itself is can be locked in any desired angle positions or at specific engaging points by means of fixing screws or locking teeth which for example can be raised against a spring force.

The angle adjustment of the cylinder, mounted so that it can rotate, which holds the bearing for the checking element, can be performed automatically by means of a drive in a further advantageous embodiment of the invention.

In a further embodiment, the bearing for the checking element is not mounted so that it can swivel around an axis but is able to be locked in various positions especially parallel to the needle bar e.g. in a longitudinal slot. Moving the bearing in the longitudinal slot may be undertaken manually or automatically by means of a drive as in the embodiments described above.

In a further form of the embodiments described above, the material thickness close to the presser foot is determined underneath the presser foot by means of a sensor and the position of the checking element is regulated to correspond automatically by means of a drive. This has the advantage of guaranteeing that even in the case of a workpiece which has different degrees of thickness at different points, the presser foot always strikes the workpiece in the bast possible way during the embroidery or sewing process.

BRIEF DESCRIPTION OF THE DRAWINGS

Various embodiments of the invention are described in greater detail below on the basis of drawings.

These show.

DETAILED DESCRIPTION OF THE INVENTION

Figure 1:
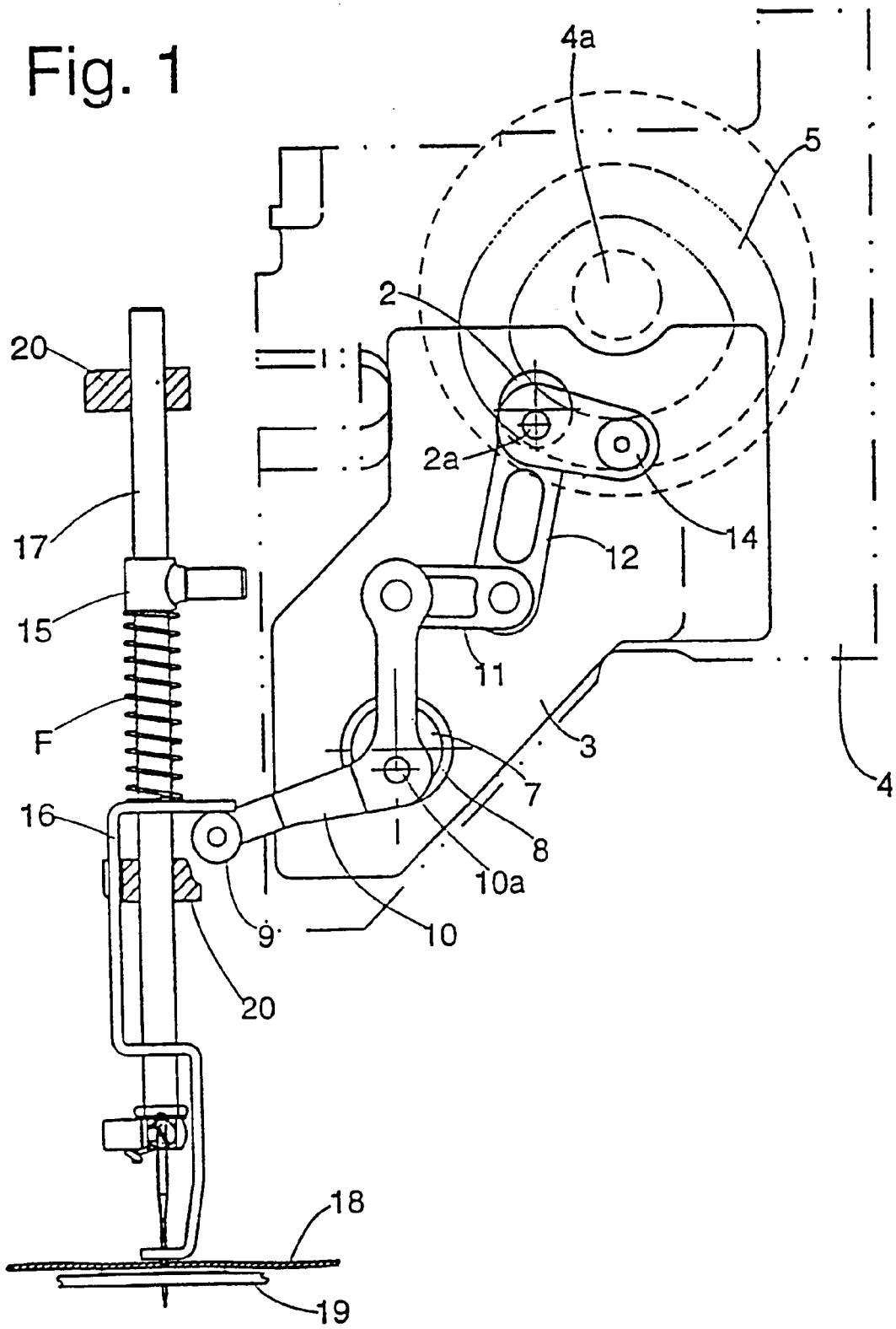
FIG. 1 a side view of an embroidery head with a checking unit according to the invention.

FIG. 1 shows a side view of the principal parts of the checking unit. The embroidery head 4, on which the parts of the checking unit and the needle bar guide and the needle bar drive are arranged, is shown as a dashed line. At least one cam disc 5, which deflects a cam lever 12, which is mounted so that it can swivel by means of the cam lever bearing 2, is arranged on a shaft 4*a*, which passes through and engages with the one embroidery head 4, or also further embroidery heads, if the shaft 4*a* is rotated. An angled lever 10, which forms the checking element and is mounted rotatably so that it can swivel around the axle 10*a* is deflected via a connecting rod 11. The free end of the one angle arm of the angled lever 10 supports a roller 9 which checks and releases the presser foot 16, accelerated downwards by the spring F, according to the movement of the angled lever 10, which is specified by the design of the guide curve of the cam disc 5. The needle bar 17 is held by a guide 20 and is driven via the needle bar drive 15, which is not shown in greater detail in FIG. 1. Like the angled lever 10, the needle bar drive 15 can be driven by the shaft 4*a*.

Figure 2A:
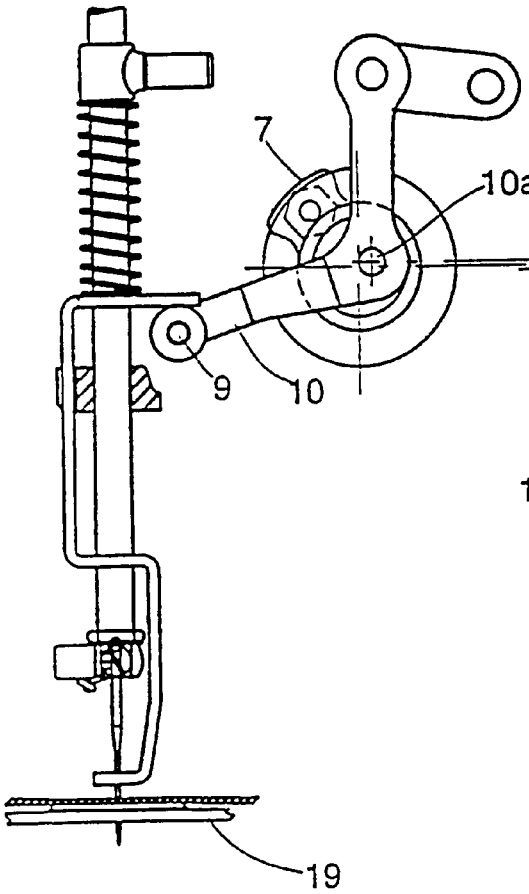
FIGS. 2*a*+2*b*: different settings for the position of the checking element.
Figure 2B:
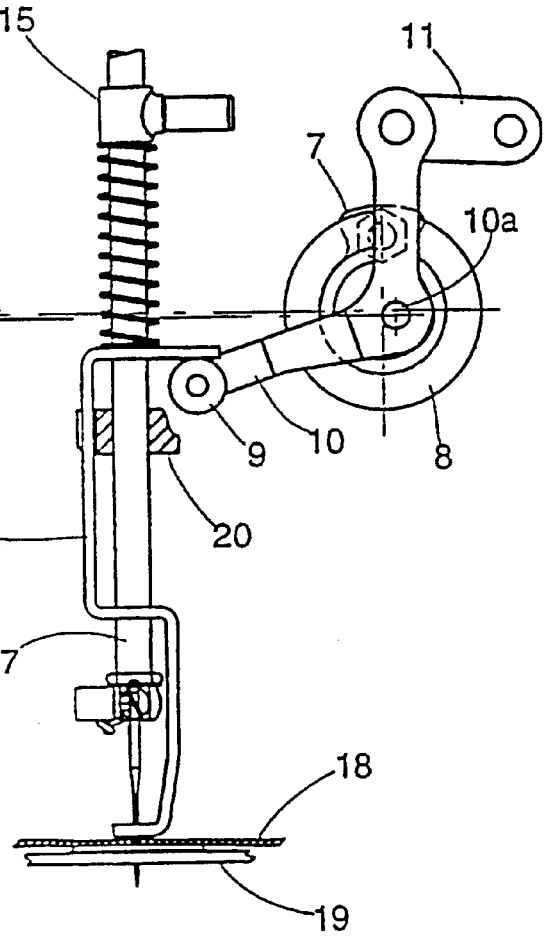

As is shown by FIGS. 2*a* and 2*b*, by turning an eccentric bolt 7, the position of the axle 10*a* of the angled lever 10 can be adjusted relative to the needle plate 19 and the embroidery material or workpiece 18. The eccentric bolt 7 is mounted in a bearing bush 8 for this and can be locked in any desired angle positions by means of a fixing screw 6 (FIG. 3).

In addition to the adjustment of the height of the angled lever 10, it is possible to lock the swivelling axle of the cam lever 12 in different positions. The device has a bearing pin 2*a* for this purpose, which is arranged eccentrically to an axis of rotation of the component 2. The component 2 rests in a bore with its cylindrical component 2*b* in a bore 3*a* of a base plate 3 and is mounted in this so that it can rotate. The bearing pin 2*a* engages with the bore 3*a* and serves as a bearing for the cam lever 12. The component 2 can be locked in any desired angle positions (arrows) in respect of the base plate 3 by means of a plate 1 and a fixing screw 1*a*. By rotating the component 2, the bearing pin 2*a* is swivelled around the axis of rotation of the component 2 and therefore changes its position.

A roller 14 or a ball bearing, which rests in the guide curve of the cam disc 5 and follows the latter when the cam disc 5 is rotated, is mounted on the one arm of the cam lever 12 on a pin 13. The other arm and therefore the angled lever 12 is swivelled correspondingly.

Figure 3:
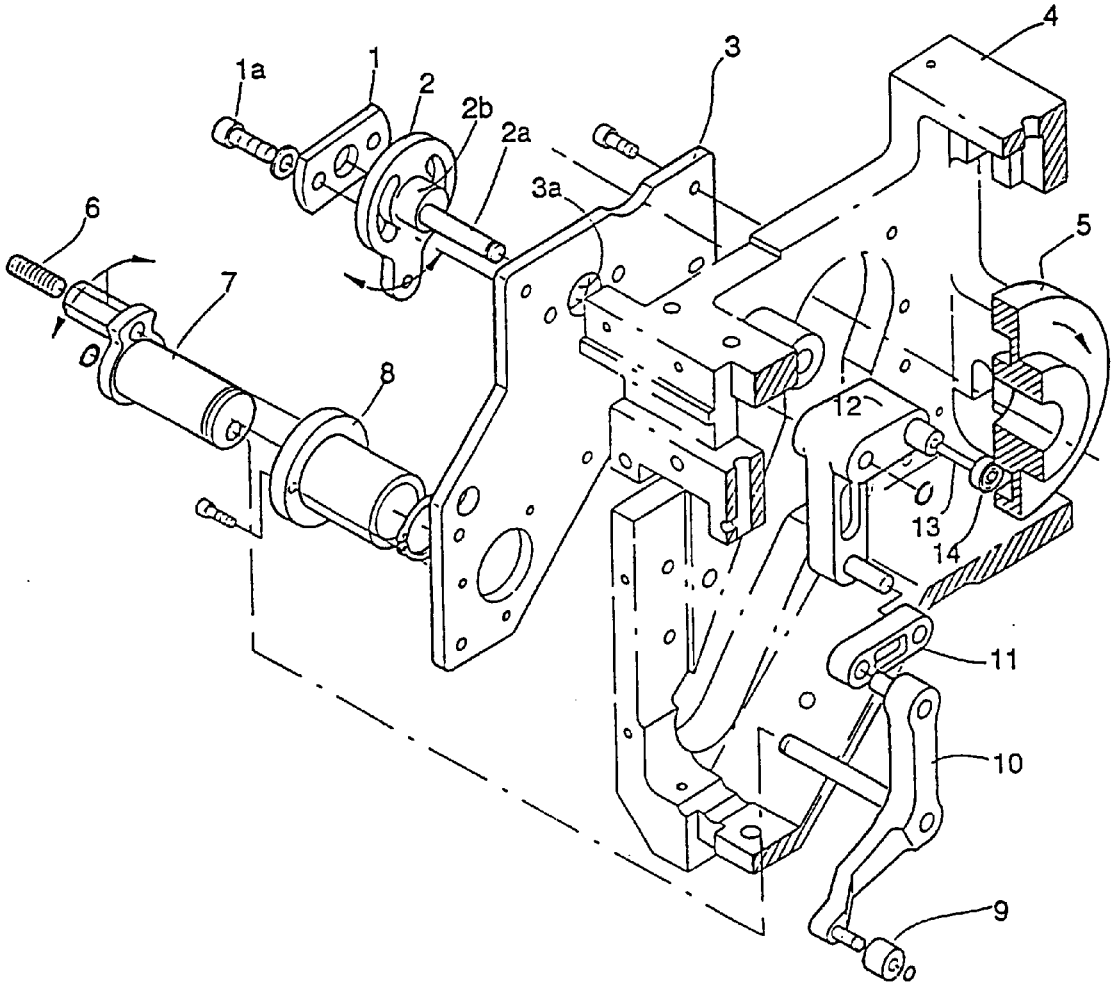
FIG. 3 an exploded representation of the parts of an embroidery head relevant to the checking unit.
Figure 4:
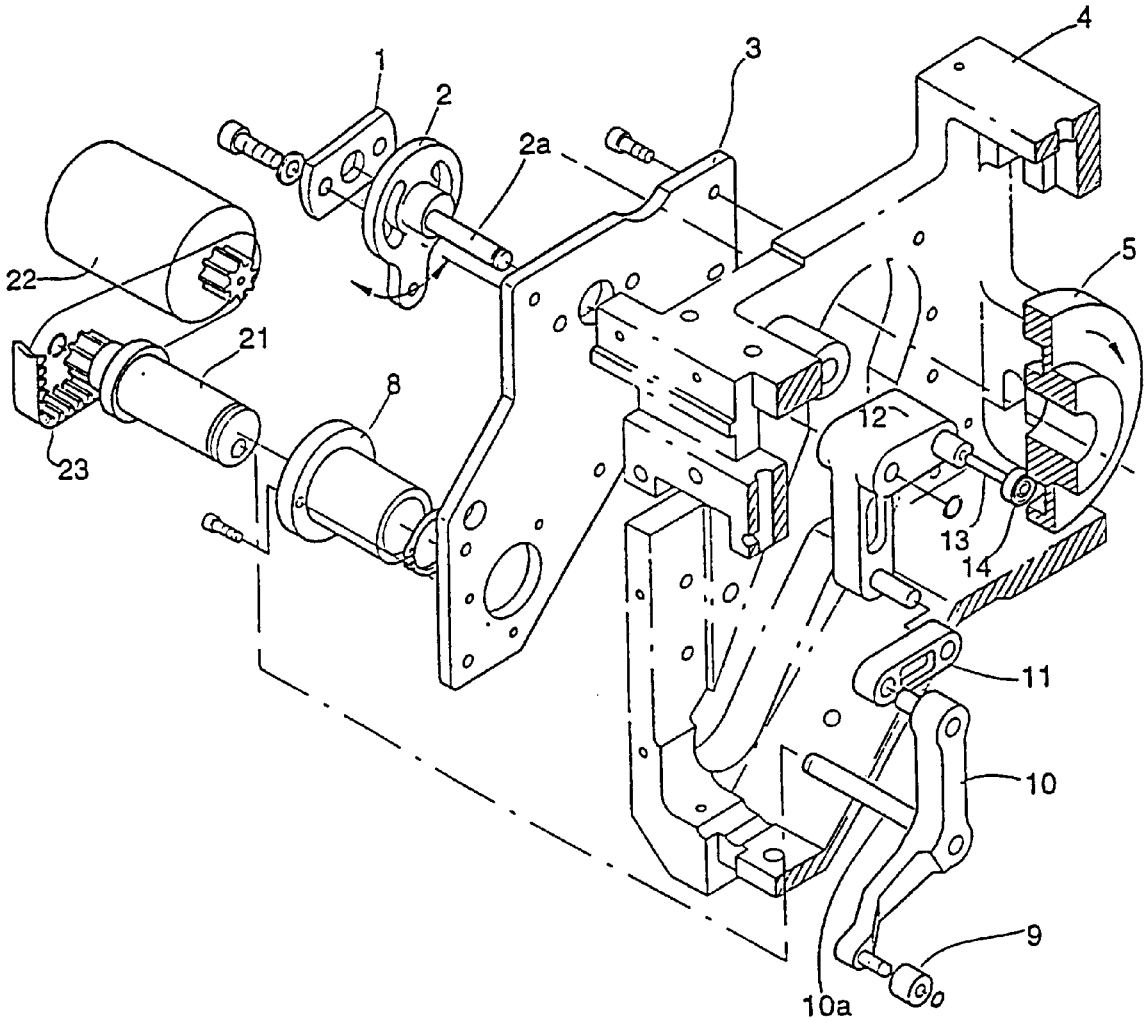
FIG. 4 an exploded representation of a checking unit according to the invention with an electric drive to adjust the bearing of the checking element automatically.

FIG. 4 shows a further embodiment of the device according to the invention, the structure of the device being substantially similar to the embodiment according to FIG. 3, whereby, however, the eccentric bolt 7 is replaced by an eccentric bolt 21 which has teeth (toothed wheel) on its one end which are connected to a servo-motor 22 via a toothed belt 23. The eccentric bolt 21, and with it the bearing 10*a* of the angled lever 10, are automatically adjusted by means of the servo-motor 22 and held in position.

Figure 5A:
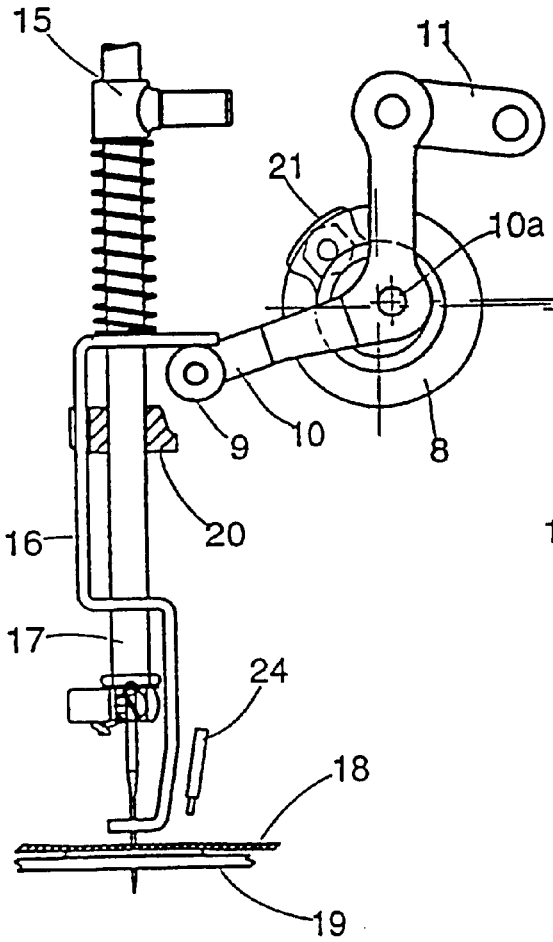
FIGS. 5*a*+5*b*: Checking unit with distance sensor
Figure 5B:
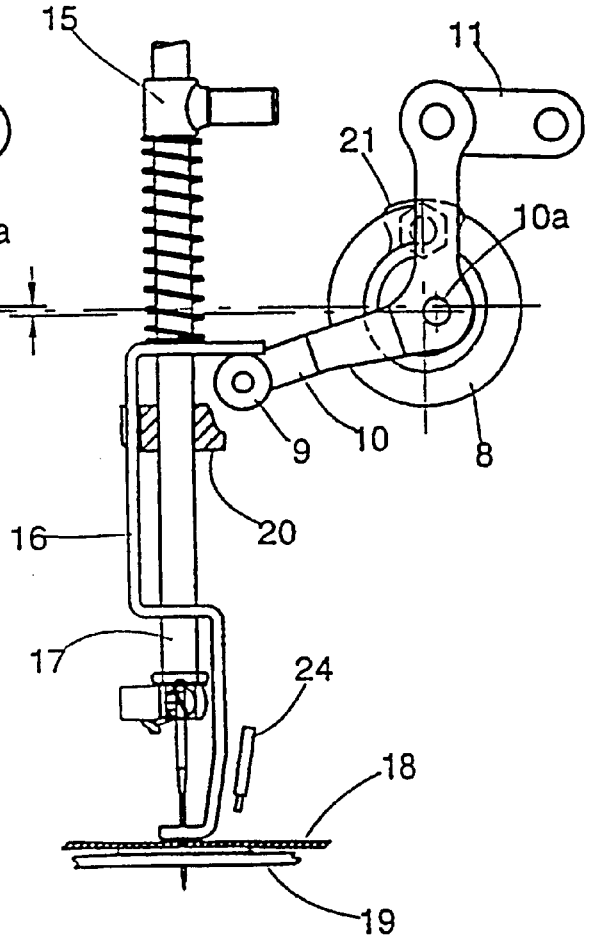

FIGS. 5*a* and 5*b* show a further embodiment of the device according to FIG. 4, which possesses an additional sensor 24, which measures the thickness of the material and/or the distance of the surface of the material 18 from the sensor 24. The eccentric bolt 21 is turned corresponding to the sensor data, by means of the actuating drive 22, not shown, the swivelling axle 10*a* of the angled lever 10 being swivelled relative to the needle plate 19. The connecting rod 11 serves to compensate for the relative movements between the angled lever 10 and the cam lever 12 during the adjustment either of the cam lever 12 or the angled lever 10 by means of the respective adjusting device.

In embodiments, which are not shown, the bearing and/or the swivelling axle of the angled lever is not mounted so that it can swivel around an axis but is moved in a linear manner, manually or by means of a drive, and locked in the position required. It is also feasible that the bearing and/or the swivelling axle can be moved along any desired paths and locked.

Figure 6:
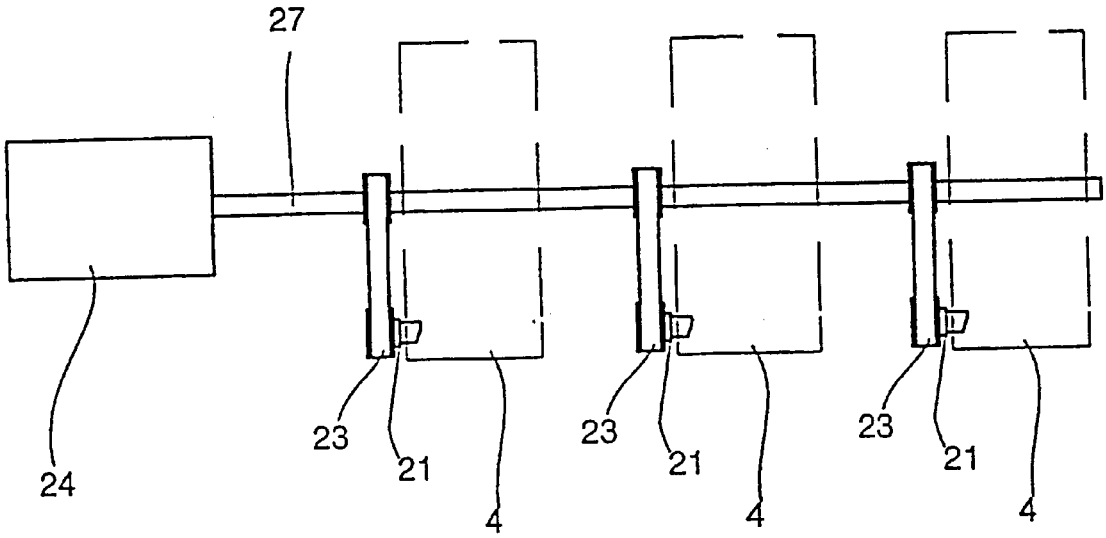
FIG. 6: A multi-head embroidery machine with a central drive for the device according to the invention.

FIG. 6 shows a multi-headed embroidery machine with a central drive 24, which drives eccentric bolts 21 of the individual embroidery heads 4 of the machine via a shaft 27 and toothed belts 23, whereby it is possible to make a simultaneous height adjustment of the presser foot attachments of all the embroidery heads simultaneously. As all the embroidery heads usually embroider identical embroidery designs, it is sufficient to determine the distance between the surface of the embroidery and the needle plate on just one embroidery head or embroidery design in order to undertake the height adjustments for all the embroidery heads simultaneously on the basis of the distance determined. In an embodiment, which is not shown, couplings are provided between the shaft 27 and the eccentric bolt 21 so that the height adjustment of specific embroidery heads 4 can be switched on or off optionally, depending on the requirement. Thus in multi-headed embroidery machines, e.g. as a consequence of the size of the embroidery design, often only certain embroidery heads are required such as e.g. every second, third etc. embroidery head. The other embroidery heads are disconnected from the main drive shaft. In this case the couplings can be used to switch off the presser foot attachments of the embroidery heads which are not required.

What is claimed is:

1. Device for adjusting a catching unit of a presser foot (16) of a sewing or embroidery machine, a needle bar (17) moving the presser foot (16) in the direction of a needle plate (19) including the action of a spring (F) and the catching unit catching the presser foot (16) before it strikes the workpiece (18) to be processed by means of a catching element (10) of the catching unit and controlling its movement up to striking the workpiece (18), the catching element (10) being driven by a common drive together with the needle bar (17) characterised in that the bearing forming the axle (10*a*) of the catching element (10) is arranged axis-parallel to the axis of rotation of a rotating body (7), the rotating body (7) being mounted on the sewing machine so that it rotates, the position of the bearing being adjustable relative to the needle plate (19) by turning the rotating body (7).

2. Device according to claim 1, characterised in that the rotating body (7) can be locked in a specific position by means of a locking element (6).

3. Device according to claim 2, characterised in that the rotating body (7) can be turned by means of a drive (22) and can be held and/or locked in at least one position.

4. Device according to claim 2, characterised in that the locking element is a fixing screw.

5. Device according to claim 1 characterized in that the catching element (10) is an angled lever.

6. Device according to claim 1 characterized in that the bearing and/or the axle (10*a*) can be locked in at least two positions relative to the needle plate (19).

7. Device according to claim 1 characterized in that the movement of the catching element (10) is controlled by a control cam (5) driven dependent on the needle bar drive.

8. Device according to claim 7, characterised in that a compensation element is inserted between a cam lever (12) moved by the control cam and the catching element (10).

9. Device according to claim 8, characterised in that the compensating element is a connecting rod.

10. Device according to claim 8, characterised in that the cam lever (12) is an angled lever, which is mounted around an axle **(2*a*) on the sewing machine so that it can swivel, the position of the axle (2*a*) being adjustable relative to the axle (4*a*) of the control cam (5) by means of an adjusting device (2) and able to be locked in various positions by means of a locking device (1)**.

11. Device according to claim 10, characterised in that the locking device is a fixing screw.

12. Device according to claim 1 characterized in that a control determines the thickness of the workpiece close to at least one presser foot (16) by means of at least one sensor (24) and, using the drive (22), sets or regulates the position required for the catching element (10) for the workpiece thickness established.

13. Device according to claim 12 characterized in that the control adjusts or regulates the position required for the catching element (10) continuously or at predefined intervals during the sewing process.

14. Device according to claim 1 characterized in that the height adjustment of the presser foot attachments (16) of the embroidery heads (4) is undertaken by a common drive (24).

15. Device according to claim 14, characterised in that a common shaft (27) connects the drive (24) to the means of adjustment to move or advance the bearing or the axle **(10*a*)**.

16. Device according to claim 15 characterised in that at least one coupling is arranged between the shaft (27) and each bearing and/or each axle **(10*a*)**.

17. Device for adjusting a catching unit of a presser foot (16) of a sewing or embroidery machine, a needle bar (17) moving the presser foot (16) in the direction of a needle plate (19) including the action of a spring (F) and the catching unit catching the presser foot (16) before it strikes the workplace (18) to be processed by means of a catching element (10) of the catching unit and controlling its movement up to striking the workpiece (18), the catching element (10) being driven by a common drive together with the needle bar (17), the position of the bearing of the catching element (10) being alterable relative to the needle plate (19) characterised in that a control determines the thickness of the workpiece close to at least one presser foot (16) by means of at least one sensor (24) and, using the drive (22), sets or regulates the position required for the catching element (10) for the workpiece thickness established.

* * * * *